US006986696B1

(12) United States Patent
Jagaric et al.

(10) Patent No.: US 6,986,696 B1
(45) **Date of Patent: *Jan. 17, 2006**

(54) PADS HAVING A CENTRAL SUMMIT FOR BRAS AND THE LIKE

(75) Inventors: Andrea Jagaric, New York, NY (US); Nathalie Martinet, New York, NY (US); Judith Grigor, New York, NY (US)

(73) Assignee: Victoria's Secret Stores, Inc., New York, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/911,269

(22) Filed: Aug. 4, 2004

(51) Int. Cl.
*A41C 3/00* (2006.01)

(52) U.S. Cl. ..... 450/39; 450/57

(58) Field of Classification Search ..... 450/39, 450/38, 54–57; 2/455, 267, 268, 463.92; 623/7, 8; 156/245; 264/258, 291, 292, 294, 264/145, 148, 152–157, 160, 163, 554
See application file for complete search history.

(56) References Cited

U.S. PATENT DOCUMENTS

| | | | | | |
|---|---|---|---|---|---|
| 2,664,571 | A * | 1/1954 | Kempel | 450/57 |
| 2,834,352 | A * | 5/1958 | Ullian | 450/57 |
| 2,867,818 | A * | 1/1959 | Creamer | 623/7 |
| 2,896,631 | A * | 7/1959 | Block | 450/51 |
| 3,620,222 | A * | 11/1971 | Kempel | 450/57 |
| 4,008,029 | A * | 2/1977 | Shokite | 425/157 |
| 4,080,416 | A * | 3/1978 | Howard | 264/258 |
| 4,250,137 | A * | 2/1981 | Riedler | 264/554 |
| 6,042,608 | A * | 3/2000 | Ishikawa et al. | 623/7 |
| 6,881,123 | B1 * | 4/2005 | Klakauskas | 450/39 |

* cited by examiner

*Primary Examiner*—Gloria M. Hale
(74) *Attorney, Agent, or Firm*—Colucci & Umans; Angelo Notaro; Peter C. Michalos

(57) ABSTRACT

A method of manufacturing a bra pad having a thicker summit area, as well as the pad itself, includes holding a sheet of resilient and formable material of uniform thickness, such as thermoplastic foam, and forming the sheet to have a graduated thicker summit area corresponding to each summit of a bra or bra-like garment for including the pad, and a surrounding thinner area. Each pad thus has a thicker summit area for extending over the summits of the breasts.

13 Claims, 5 Drawing Sheets

PADS HAVING A CENTRAL SUMMIT FOR BRAS AND THE LIKE

FIELD AND BACKGROUND OF THE INVENTION

The present invention relates generally to the field of bras and related garments, and in particular to a new and useful method and pad product having a thicker central summit area for use in bras, camisoles, slips, swimsuits or any other breast covering garment where padding is desired.

It is known to provide resilient pads in bras to accentuate the figure. Padded bras are not always desirable, however. Bras without pads are also known but these have limited ability to enhance the figure.

U.S. Pat. No. 4,013,750 discloses a method for making brasserie pad pre-forms which can produce a bra pad having a thicker central region than its outer regions. A mold apparatus is utilized which produces a substantially conical pad of polyester fibers with a summit which is thicker than the periphery of the conical pad. Also see U.S. Pat. No. 3,947,207.

Other patents of interest to the present invention are:

| U.S. Patent No. | Inventor(s) |
|---|---|
| 2,507,543 | Prager |
| 2,565,400 | Skeoch |
| 2,616,093 | Talalay |
| 2,627,368 | Jantzen |
| 2,702,769 | Alderfer |
| 2,845,974 | Ashton et al. |
| 3,164,655 | Howard et al. |
| 3,186,271 | Kaiser |
| 3,311,007 | McGee |
| 3,417,755 | Howard et al. |
| 3,464,418 | Silverman |
| 3,502,083 | Howard et al. |
| 3,800,650 | Schroder |
| 4,351,211 | Azzolini |
| 5,017,174 | Gowrylow |
| 5,299,483 | Ber-Fong. |

U.S. Pat. No. 2,627,368 to Jantzen discloses a method of making curved pad filler in which a mold is provided with a concave part for receiving a part of a blank of material. A means are provided for pushing or pressing the blank into the concave part of the mold. A sharp moving knife is passed between the mold and the pressing element, resulting in a curved shoulder pad filler and uniformly tapered portions extending from the thick end to a feathered edge.

U.S. Pat. No. 3,186,271 to Kaiser discloses an apparatus and method for producing shaped articles consisting of foam such as sponges and cushions.

Neither the Jantzen nor the Kaiser patents teach or suggest a sheet of material having a pair of thicker areas positioned so that they correspond to the location where the central summit of the bra pad will be when it is completed.

U.S. Pat. Nos. 3,164,655, 3,417,755 and 3,502,083 to Howard et al. disclose molding of a blank to give it a desired shape and contour but fail to teach or suggest forming a foam sheet of material having a pair of thicker areas positioned so that their position corresponds to the location where the central summit of the bra pad will be when it is completed after thermoforming.

U.S. Pat. No. 2,616,093 to Talalay discloses an apparel pad such as a shoulder or breast pad, which as a concavo-complex shape with a thickness graduated from a relatively thick portion to a relatively thin portion using different pieces of material to build up the pad.

U.S. Pat. No. 3,311,007 to McGee discloses an apparatus for producing at least one contoured surface upon a foamed material pad but is very different from the present invention because it teaches the effects of cutting a foam member which is compressed by a male mold portion against an opposite flat mold portion, and thus, the contour of the shaved material is based on the shape of the male mold portion. McGee fails to teach contouring of an article based on a foam material being pressed to cover and penetrate a recess before the foam material is shaved.

U.S. Pat. No. 2,727,278 to Thompson discloses a method of making a molded composite bra, in which the thickness of filler material in each bra pad has a summit thickness greater than the thickness surrounding the summit. The process for making the molded bra is however very different from the present invention and does not teach shaving a material compressed into a recess.

The remaining patents disclose other pad-related technology which are distinguishable from the invention, and they are enclosed for general reference.

A need remains for an improved pad, as well as a method for producing such a bra pad, which adds some padding effect to the bra but in a very subtle manner so that the padding is barely perceptible.

SUMMARY OF THE INVENTION

It is an object of the present invention to provide a method of manufacturing a bra pad having a thicker central summit area, as well as the pad itself and the apparatus for manufacturing the pad, comprising holding a sheet of uniform thickness, resilient and formable material, such as thermoplastic foam, and forming the sheet to have one or two thicker summit areas corresponding to the summits of the bra or bra-like garment (here called a bra for any garment in which the pads are ultimately used). Each pad thus has a thicker summit area for extending over the summits of the breasts of a wearer of the bra.

A further object of the invention is to provide the bra pad made in accordance with the method of the invention.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DESCRIPTION OF THE PREFERRED EMBODIMENTS

Figure 1:
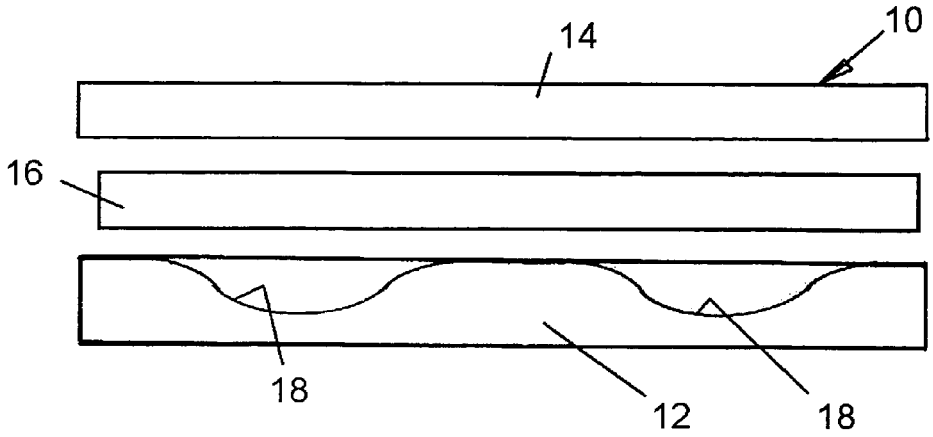
FIG. 1 is a side elevation view of an open shaving mold used to make the pads and to practice the method of the present invention with a sheet of polyurethane foam material therebetween.

Referring now to the drawings, in which like reference numerals are used to refer to the same or functionally similar elements, FIG. 1 shows a first or shaving mold generally designated 10 comprising a lower shaving mold portion 12 and an upper shaving mold portion 14 with a thickness of e.g. 7 mm polyurethane foam 16 therebetween. Although polyurethane foam is illustrated, any thermo plastic foam material can be used according to the present invention and in fact any formable material can be used which is resilient and is capable of being formed into a permanent yet resilient three-dimensional shape. The shaving mold halves or portions 12 and 14 can be made of wood, plastic, metal or other suitable rigid material. Lower mold half 12 contains a pair of graduated recesses 18 in its upper surface which are positioned so that they are near the central summit of each bra pad to eventually be made in accordance with the present invention.

Figure 2:
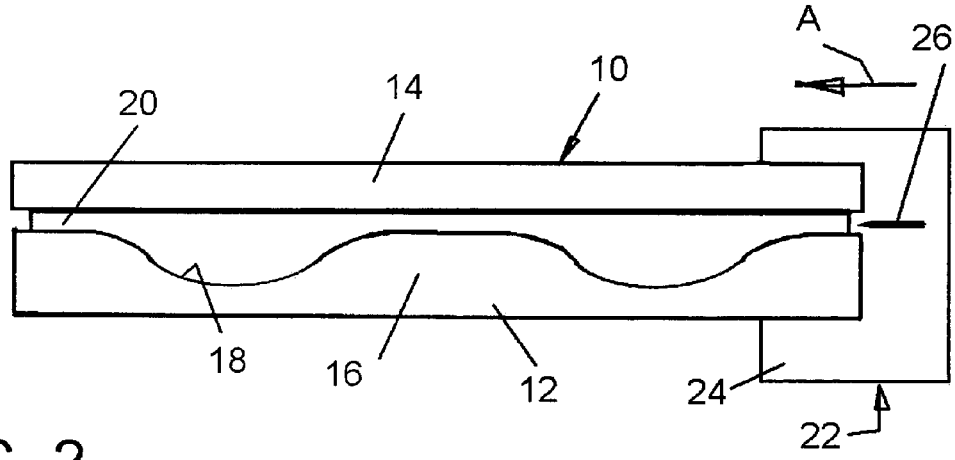
FIG. 2 is a view similar to FIG. 1 of the shaving mold in its closed position and with a shaving device in an initial position of use.

FIG. 2 illustrates the shaving mold in its closed position with the resilient formable sheet of material 16 pressed down onto the lower mold half so that some of the material of sheet 16 is pressed into each recess 18 but also a thickness of material, for example at 20, remains along the shaving mold halves.

A shaving apparatus generally designated 22 is also illustrated in FIG. 2 which comprises a movable carriage 24, which carries a blade, knife or shaving member 26 that extends transversely the full width of material sheet 16 (perpendicular to the plane of FIG. 2). Blade 26 is also positioned intermediate to the upper and lower shaving mold halves 14, 20 respectively so that a portion of the layer 20 can be neatly shaved from the sheet 16. For this purpose, member 26 may be heated (e.g., a cutting wire), may be mounted for movement like a band saw, may be reciprocally vibrated back and forth like an electric knife or oscillated in any other appropriate way for cutting the foam material of sheet 16.

Figure 3:
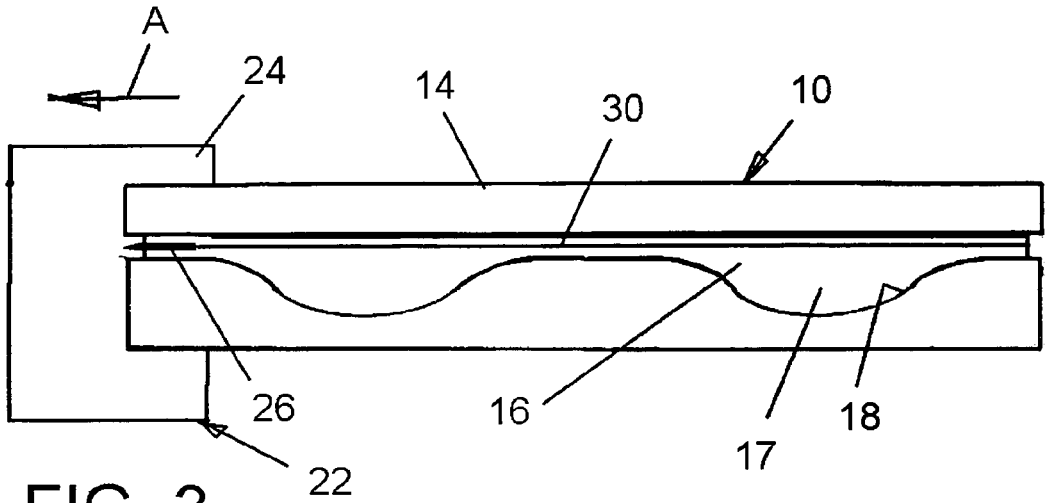
FIG. 3 is a view similar to FIG. 2 with the shaving apparatus in a final position.
Figure 4:
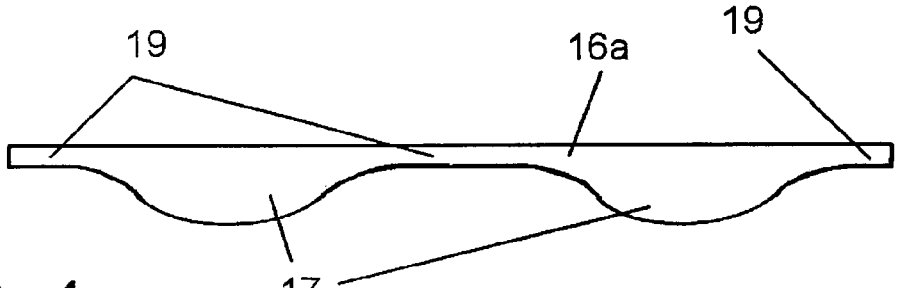
FIG. 4 is a side elevational view of a shaved or graduated sheet component of the bra pad in accordance with the present invention.
Figure 8:
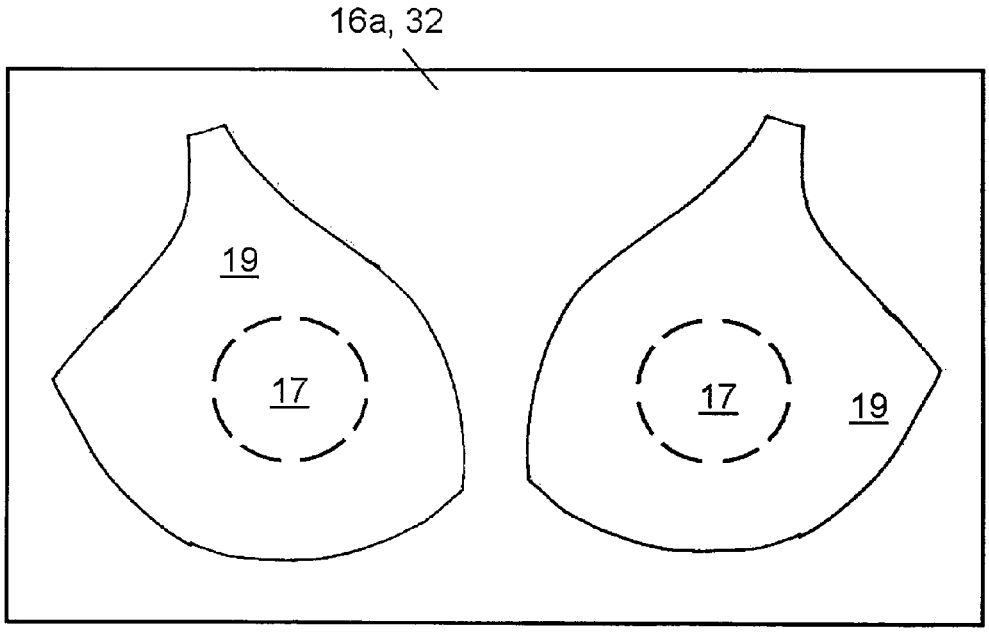
FIG. 8 is a top plan view of the formed component of FIG. 7.

With the shaving apparatus 22 activated to vibrate, heat or otherwise activate member 26, the carriage 24 is moved in the direction of arrow A and across the sheet 16 until it reaches its final position shown in FIG. 3. In this position a slice 30 has been made in sheet 16 thus achieving the shaving effect. FIG. 4 shows the shaved component or graduated sheet 16*a* which is removed from the shaving mold after it is opened and which contains a pair of thicker material areas 17 at a summit e.g. of 5.5 mm thickness, surrounded by thinner material areas 19, e.g. 1 mm thick. FIG. 8 illustrates in dotted line the two summit areas 17 on the rectangular and graduated sheet 16*a* which, in FIG. 8, has already been attached to as second outer cup sheet 32, e.g. 2 mm thick, shown in FIG. 5 which is also made of polyurethane foam material. Shaved or graduated sheet 16*a* forms an inner cup sheet.

Figure 5:
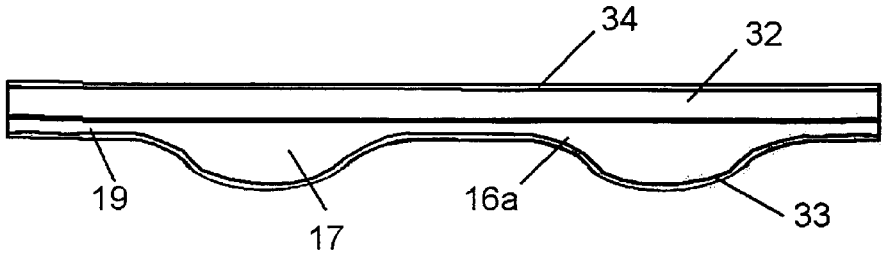
FIG. 5 is a view similar to FIG. 4 of an assembled pre-form of the bra pad according to the present invention.

As shown in FIG. 5, each of the cup sheets 16*a* and 32 may also include a laminate or fabric covering 33 and 34, respectively, made, for example, of nylon or nylon with spandex. This is a conventional covering for foam pads used in bras. It is important that in accordance with the present invention, the laminate 33 be on the outer inner surface of the inner cup sheet 16*a* so that it is not shaved away by the shaving apparatus 22 and that the outer cup sheet 32 have its laminate 34 on its outer surface. This leaves the inner surfaces of panels 16*a* and 32 free to receive sprayed on glue. After the glue is sprayed on the two surfaces are pressed against each other to produce the single composite pre-form illustrated in FIG. 5.

Figure 6:
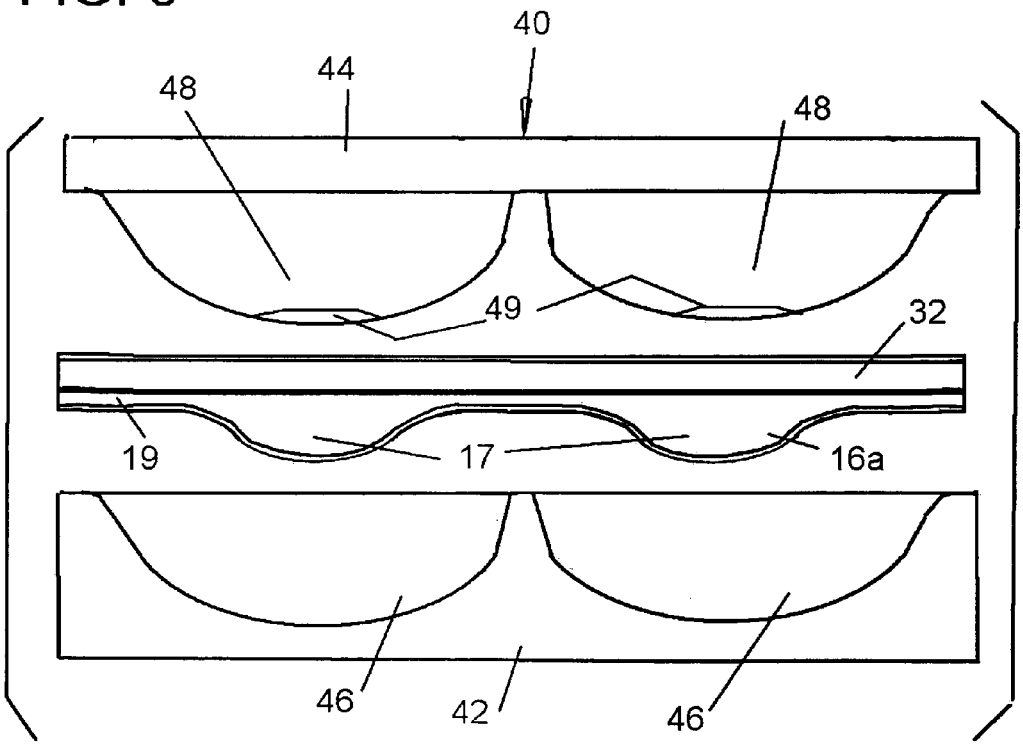
FIG. 6 is an exploded view of a forming mold with the pre-form bra pad between the mold halves thereof.

In FIG. 6 a thermo-forming mold 40 is generally designated 40 and, as illustrated, includes a lower female mold portion or half 42 and an upper mold half or portion 44. The pre-form 16*a*, 32 is positioned between the mold halves 42, 44 with the summits 17 centered on a pair of recesses 46 formed in the lower female mold half 42 which also correspond with a pair of male projections 48 formed in the male mold half 44. Each projection 48 may also include a slight recessed or flattened area 49 or an area which is shaped to keep from completely crushing the summit areas 17 of the inner cup sheet 16*a*.

Figure 7:
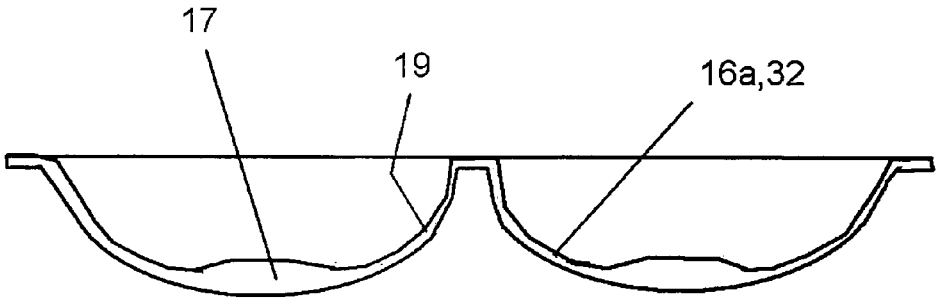
FIG. 7 is a sectional view of a formed component for creating two foam pads of the present invention.

The mold halves are heated to the appropriate level for molding the pre-form into a finished molding illustrated in FIGS. 7 and 8. The finished molding has a pair of spaced apart thicker summit areas 17, e.g. 5–6 mm thick, surrounded by the thinner surrounding areas 19, e.g. 1 mm thick, which completely encircle each summit area 17 and have an inner area of e.g. 2 mm thick, so that a bra manufactured with or containing the bra pads of the present invention will have a slightly thicker area 17, for example 3 mm, over the summit of each breast summit, and thinner material, e.g. tapering down to 1 mm, in thinner areas 19.

Figure 9:
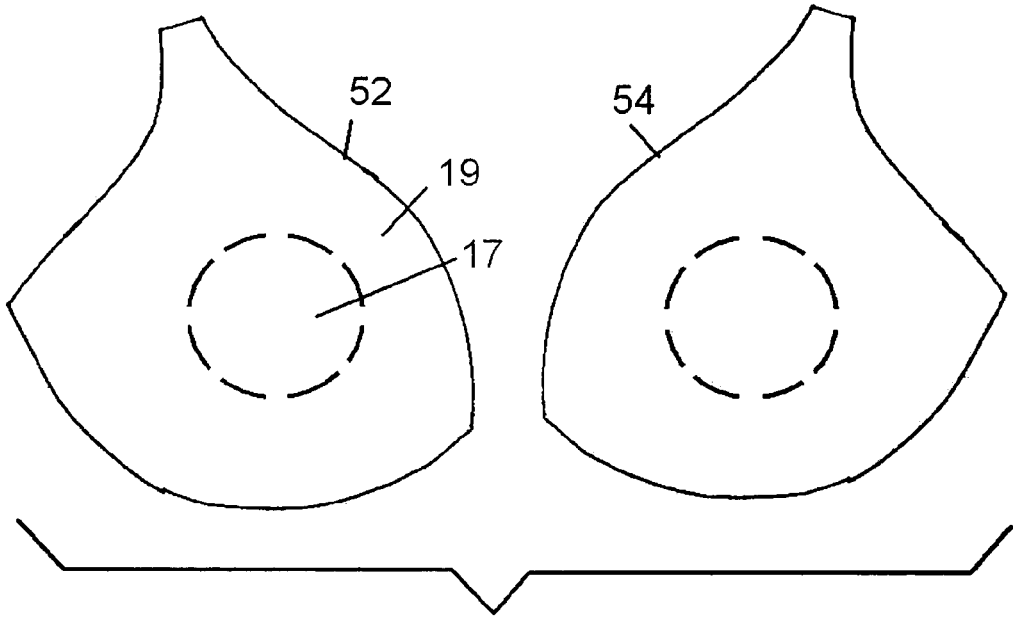
FIG. 9 is a view of a pair of bra pads constructed in accordance with the present invention.

FIG. 9 illustrates the pair of pads 52, 54 which are cut from the molding of FIGS. 7 and 8 by cutting the surrounding thinner area around the summit areas and are ready for use in a bra, in a conventional manner. The pads 52, 54 may also be used in other garments for covering the torso of a woman and which contain bra or bra-like structures such as bathing suits, camisoles, and the like.

While a specific embodiment of the invention has been shown and described in detail to illustrate the application of the principles of the invention, it will be understood that the invention may be embodied otherwise without departing from such principles.

What is claimed is:

1. A method of manufacturing a bra pad, comprising:

holding a first sheet of resilient and formable material having a uniform thickness in a first mold with at least some of the material in at least one graduated recess of the first mold;

removing some of the material from the first sheet by shaving or cutting to leave a graduated sheet of the material having at least one graduated thicker summit area of the graduated sheet corresponding to the graduated recess of the first mold and a surrounding thinner area of the graduated sheet;

adhering to the graduated sheet, a further sheet of resilient and formable material using adhesive; and then forming the graduated sheet with the adhered further sheet of material to form a bra pad.

2. A method according to claim 1, wherein the material of the first sheet is thermo-formable material.

3. A method according to claim 1, including cutting a bra pad out of the graduated sheet by cutting the surrounding thinner area around the summit area.

4. A method according to claim 1, wherein the graduated sheet has a pair of spaced apart summit areas.

5. A bra pad made by the process comprising:

holding a first sheet of resilient and formable material having a uniform thickness in a first mold with at least some of the material of the first sheet being in at least one graduated recess of the first mold;

removing some of the material of the first sheet by shaving or cutting to leave a graduated sheet of the material having at least one graduated thicker summit area of the graduated sheet corresponding to the graduated recess of the first mold, and a surrounding thinner area of the graduated sheet; and a further sheet of resilient and formable material adhered by adhesive to the graduated sheet of resilient and formable material.

6. A pad according to claim 5, where each of the graduated and further sheets of resilient and formable material are made of thermoplastic foam and have one laminated surface and an opposite surface adhered to the other sheet of material.

7. A pad according to claim 6, wherein the sheets of resilient and formable material each comprise thermoplastic material.

8. A pad according to claim 7, wherein the thermoplastic material is polyurethane foam.

9. A bra pad made by the process comprising:

holding a first sheet of resilient and formable material having a uniform thickness in a first mold with at least some of the material of the first sheet in at least one graduated recess of the first mold;

removing some of the material of the first sheet by shaving or cutting to leave a graduated sheet of the material having at least one graduated thicker summit area of the graduated sheet corresponding to the graduated recess of the first mold, and a surrounding thinner area of the graduated sheet; and providing a further sheet of resilient and formable material adhered by adhesive to the graduated sheet of resilient and formable material with a fabric laminate on outer surfaces of each sheet of material which is opposite from a surface at which the sheets of material are adhered to each other.

10. A pad according to claim 9, including forming the graduated sheet with the adhered further sheet of material to form a bra pad.

11. A pad according to claim 9, wherein the material of the first sheet is thermo-formable material.

12. A pad according to claim 9, including cutting the bra pad out of the graduated sheet by cutting the surrounding thinner area around the summit area.

13. A pad according to claim 9, wherein the graduated sheet has a pair of spaced apart summit areas.

* * * * *